US007178740B2

(12) United States Patent
Williams

(10) Patent No.: US 7,178,740 B2
(45) Date of Patent: Feb. 20, 2007

(54) PRESSURE WASHER SYSTEM AND METHOD OF OPERATING SAME

(76) Inventor: David K. Williams, 11290 Highway 191 South, #19, San Antonio, TX (US) 78223

( * ) Notice: Subject to any disclaimer, the term of this patent is extended or adjusted under 35 U.S.C. 154(b) by 0 days.

(21) Appl. No.: 10/767,610

(22) Filed: Jan. 29, 2004

(65) Prior Publication Data

US 2005/0167532 A1 Aug. 4, 2005

(51) Int. Cl.

| | |
|---|---|
| ***B05B 9/00*** | (2006.01) |
| ***B05B 9/01*** | (2006.01) |
| ***B05B 9/04*** | (2006.01) |
| ***B05B 7/02*** | (2006.01) |
| ***B05B 7/08*** | (2006.01) |
| ***B05B 7/28*** | (2006.01) |
| ***B05B 15/06*** | (2006.01) |

(52) U.S. Cl. ..... 239/10; 239/312; 239/314; 239/329; 239/332; 239/418; 239/426; 239/444; 239/525; 239/532; 239/543; 239/600

(58) Field of Classification Search ..... 239/305–306, 239/310, 312, 314, 318, 433, 601, 315–317, 239/329, 332–333, 398, 407–408, 413, 418, 239/420, 426, 434, 443–444, 525, 532, 543, 239/600, 10

See application file for complete search history.

(56) References Cited

U.S. PATENT DOCUMENTS

| | | | | |
|---|---|---|---|---|
| 3,380,658 | A * | 4/1968 | Stasz et al. | 239/130 |
| 3,997,114 | A * | 12/1976 | Hewett | 239/127 |
| 4,193,550 | A * | 3/1980 | Juttelstad et al. | 239/314 |
| 4,341,350 | A | 7/1982 | Wemmer | 239/312 |
| 5,671,889 | A * | 9/1997 | Petty | 239/418 |
| 6,360,964 | B1 | 3/2002 | Occhiogrosso | 239/172 |
| 6,571,805 | B2 | 6/2003 | Hoenisch et al. | 134/22.12 |

* cited by examiner

*Primary Examiner*—Kevin Shaver
*Assistant Examiner*—Darren Gorman

(57) ABSTRACT

A system and method for injecting a low-pressure spray of solution into a high-pressure spray of liquid produced by a pressure washing system. The system comprises a liquid storage tank for the solution that is operable to be pressurized. The system comprises a wand that is coupled to the liquid storage tank and securable to a high-pressure wand. The system may comprise a high-pressure pump that is operable to produce a high-pressure flow of fluid to the high-pressure wand. The pressure stored in the liquid storage tank provides the force to drive the solution to the discharge of the high-pressure wand.

20 Claims, 9 Drawing Sheets

PRESSURE WASHER SYSTEM AND METHOD OF OPERATING SAME

BACKGROUND OF THE INVENTION

The present technique relates generally to portable pressure washer systems. More specifically, the present technique relates to a portable pressure washer system operable to produce a high-pressure fluid stream, such as water, and to pressurize a second solution to a lower pressure for injection into the high-pressure fluid stream.

Pressure washers typically use a pump to produce a high-pressure flow of fluid, such as water, for cleaning. The high-pressure of the fluid facilitates the breakup and removal of dirt and debris on the surface of the object to be cleaned. However, it may be desirable to add a cleaning solution to the fluid flow stream produced by the pressure washer. Portable pressure washers combine the cleaning solution with the fluid upstream of the pump. Thus, the pump becomes contaminated with the cleaning solution, potentially decreasing the life of the pump or requiring the pump to be cleaned after each use. This is especially a problem when a caustic solution is used as the cleaning solution. In addition, a user has a limited degree of control the application of the cleaning solution when the cleaning solution is mixed with the fluid upstream of the pump.

Therefore, a need exists for a pressure washer that enables a user to apply a solution to a high-pressure fluid flow stream downstream of the pump. In addition, a need exists for a pressure washer system that enables a user to have precise control of the injection of the solution into the high-pressure fluid stream produced by the pressure washer.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
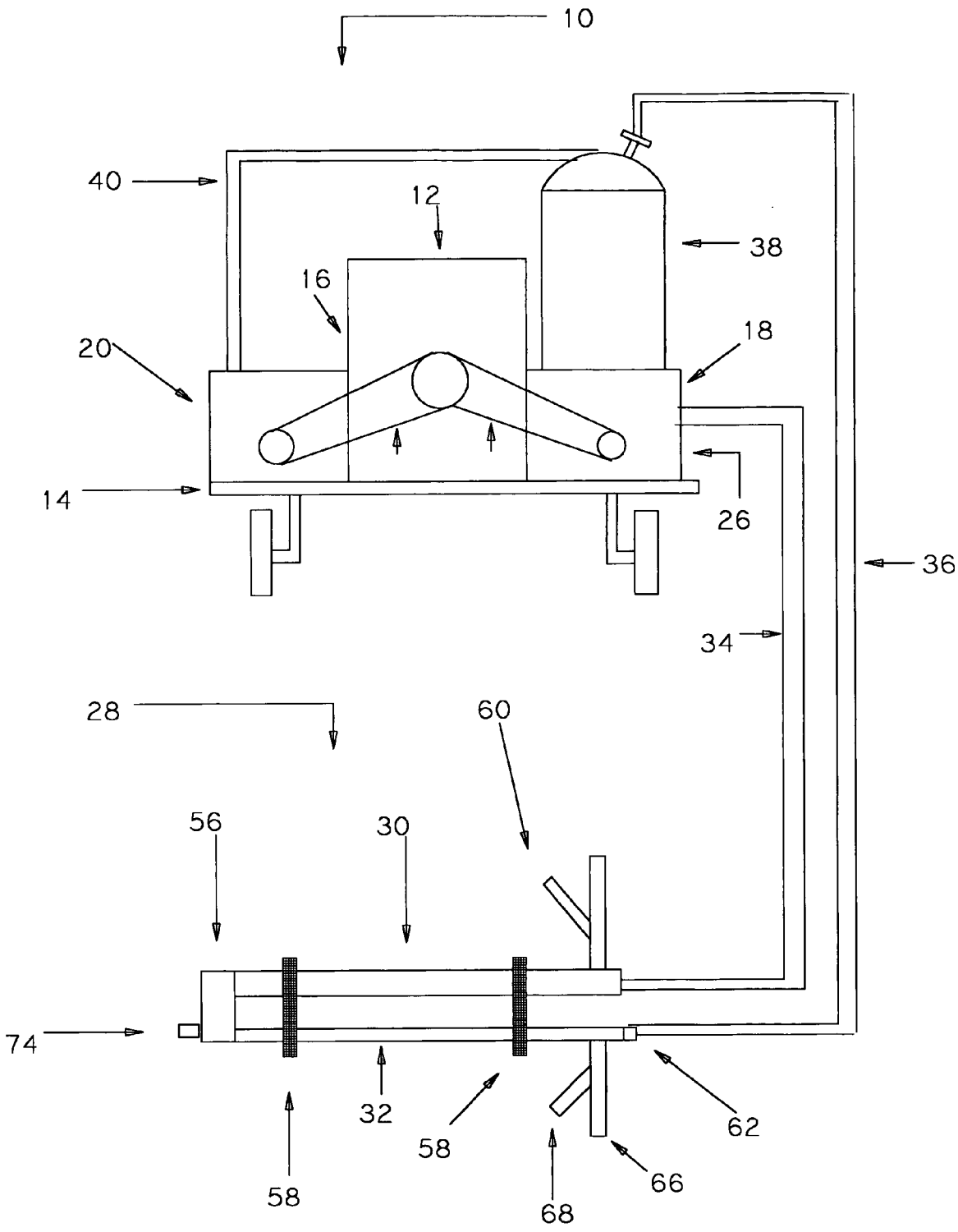
FIG. 1 is an elevation view of a portable pressure washer system, in accordance with an exemplary embodiment of the present technique.

Turning now to the drawings and referring generally to FIG. 1, an exemplary embodiment of a portable pressure washer system 10 is illustrated. In the illustrated embodiment, the pressure washer system 10 comprises a pressure unit 12 disposed on a wheeled cart 14. The illustrated pressure unit 12 comprises an engine 16 operable to drive a water pump 18 and a compressor 20. In this embodiment, the engine 16 is gasoline powered. However, engines utilizing other fuels may be used. In addition, in the illustrated embodiment, the water pump 18 is coupled to the engine 16 by a first belt 22 and the compressor 20 is coupled to the engine 16 by a second belt 24. However, other methods of coupling the motive force of the engine 16 to the water pump 18 and compressor 20 may be used. The pressure unit 12 is operable to raise the pressure of a flow from a low pressure to a high pressure to enable the pressure washer system 10 to produce a flow of high-pressure fluid. In the illustrated embodiment, the water pump 18 receives tap water from a tap via a water hose 26 connected to the tap. Preferably, the pressure unit 12 is operable to raise the pressure of the tap water to between 1800 psi and 4000 psi. However, the unit 12 may be able to raise the pressure of the fluid even higher pressures.

The pressure washer system 10 also comprises a wand assembly 28. The wand assembly 28 enables a user to direct a high-pressure flow of fluid and also enables a user to inject a solution into the high-pressure flow of fluid. The illustrated embodiment of the wand assembly 28 comprises a high-pressure wand 30 and a low-pressure wand 32. The high-pressure wand 30 is coupled to the water pump 18 by a water hose 34. The low-pressure wand 32 is coupled by a hose 36 to a pressurized storage tank 38. The storage tank 38 is used to store the solution to be injected into the high-pressure flow of fluid from the high-pressure wand 30. The pressure within the storage tank 38 provides the motive force to produce a flow of solution to the low-pressure wand 32. The solution does not flow through the pump 18 to the low-pressure wand 32. The fluid stored in the tank 32 may be a cleaning solution, such as soap. However, because the solution does not flow through the pump 18, the solution may be a caustic solvent, or some other type of fluid hostile to a pumping system. In the illustrated embodiment, the compressor 20 is used to pressurize the tank 38 to provide the motive force for driving the fluid to the low-pressure wand 32. However, as will be discussed later, a gas bottle, a pump, or another method may be used to pressurize the tank 32. In the illustrated embodiment, the compressor 20 is coupled to the tank 38 by a gas line 40. As will be discussed in more detail below, the low-pressure wand 30 enables a user to control the flow of solution from the storage tank 38 to the high-pressure flow of fluid from the high-pressure wand 30.

Figure 2:
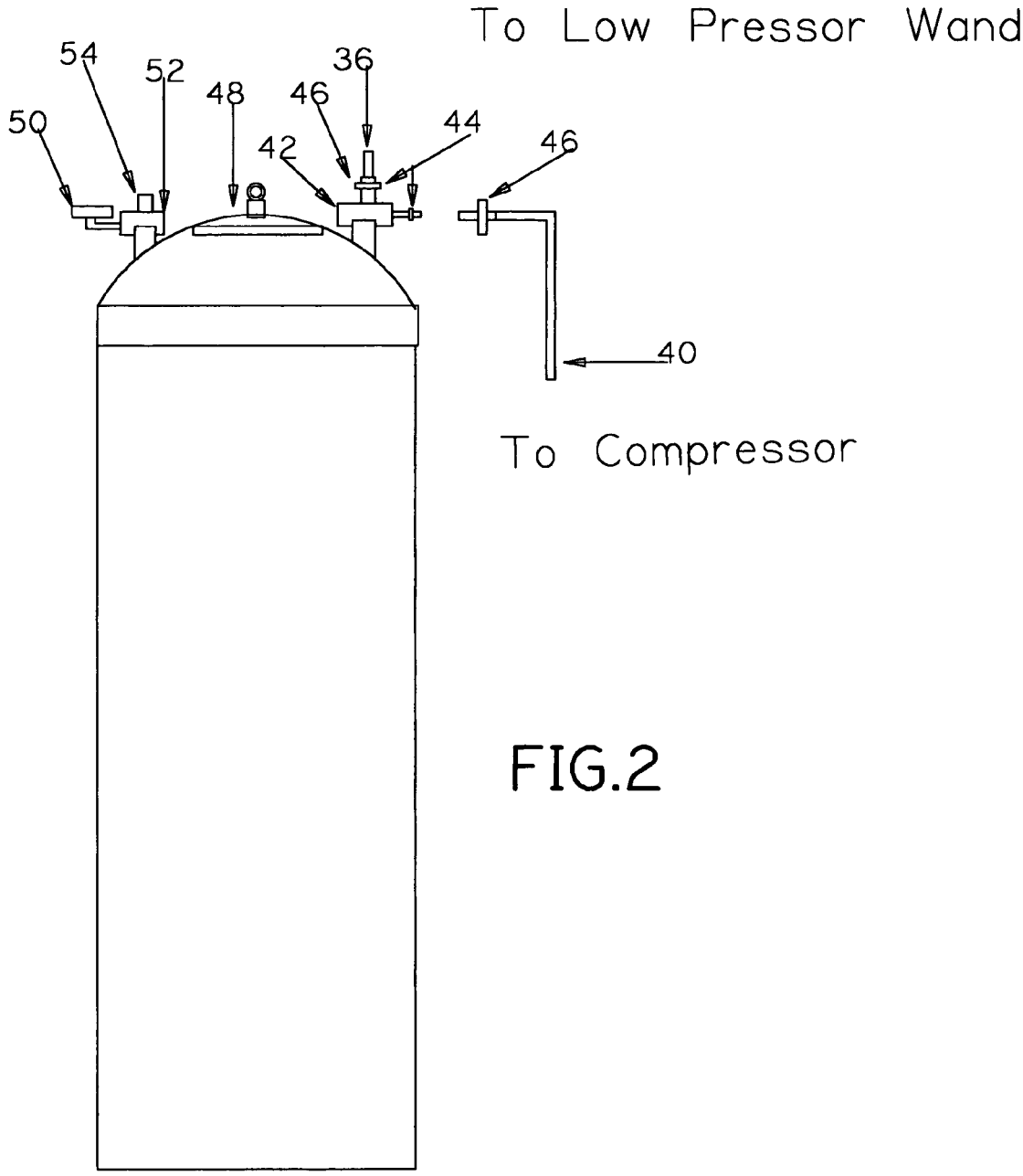
FIG. 2 is an elevation view of the storage tank assembly of the portable pressure washer system of FIG. 1.

Referring generally to FIG. 2, the storage tank 38 serves as a reservoir for the solution to be injected. In the illustrated embodiment, the storage tank 38 is stainless steel. However, other metals may be used. The storage tank 38 has a fitting 42, preferably of brass, that serves as a passageway for compressed gas to flow into the storage tank 38 and solution to flow out of the storage tank 38. In the illustrated embodiment, the fitting 42 is a tee fitting with one leg of the tee secured to the tank 38 and the low-pressure wand hose 36 and the gas line 40 connected to the other two legs of the tee. In addition, in this embodiment, two push-type quick connectors 44 are connected to the fitting 42 to enable the low-pressure wand hose 36 and the gas line 40 to be easily attached and removed. Corresponding push-type quick connectors 46 are connected to the low-pressure wand hose 36 and the gas line 40. The storage tank 38 also comprises a pressure relief 48. In addition, the storage tank 38 comprises a pressure gauge 50. The pressure gauge 50 is connected to the storage tank 38 by a fitting 52. The fitting 52 also has a valve stem inlet 54.

Figure 3:
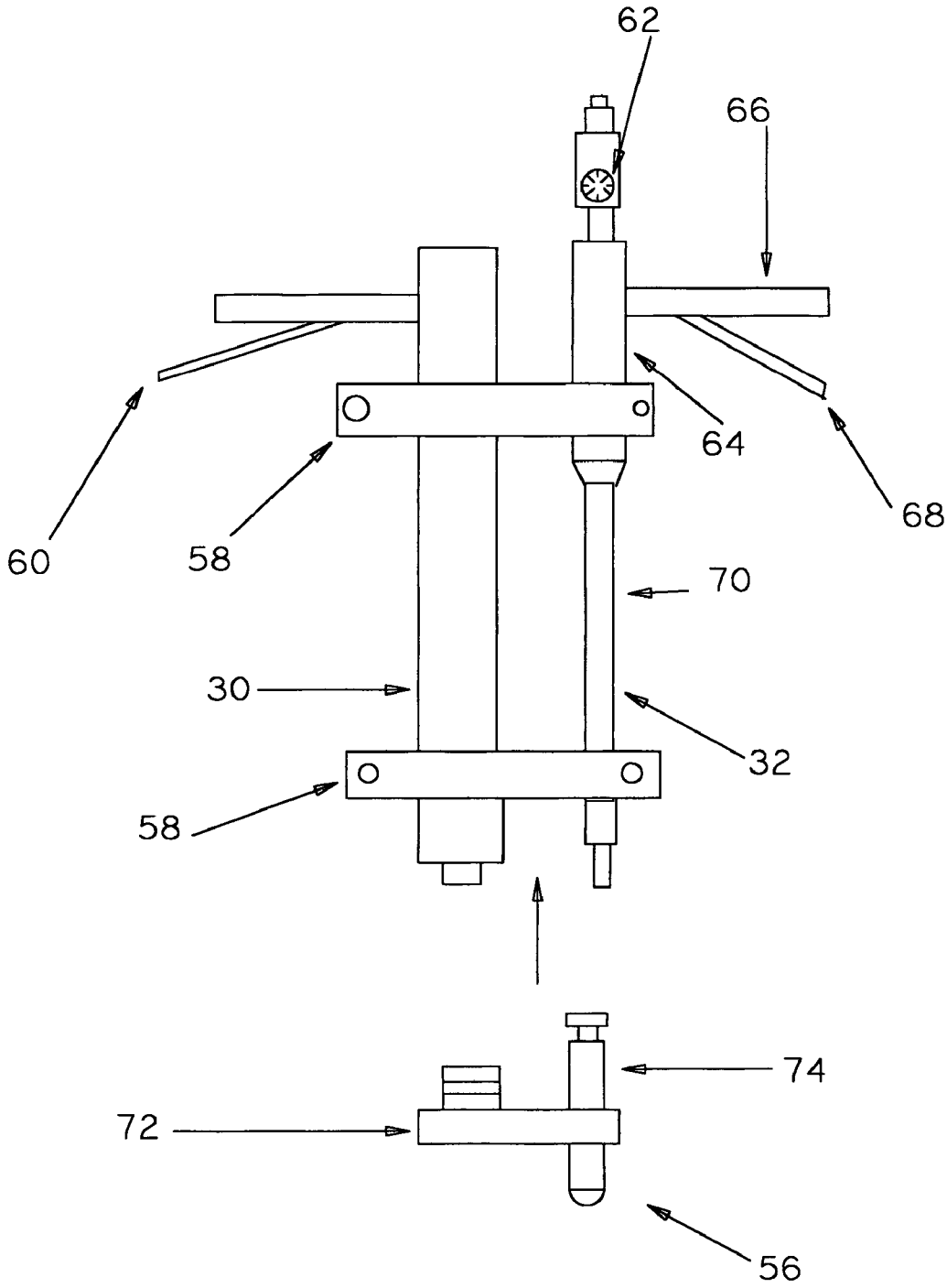
FIG. 3 is an elevation view of the wand of the portable pressure washer system of FIG. 1.

Referring generally to FIG. 3, the low-pressure wand 32 may be added to an existing pressure washer system as a kit. In the illustrated embodiment, an adapter assembly 56 is provided to couple the low-pressure wand 32 to the high-pressure wand 30. In addition, as discussed below, the adapter assembly 56 is operable to direct solution from the low-pressure wand 32 into the high-pressure flow of fluid from the high-pressure wand, producing a mixture of a low-pressure solution with a high-pressure liquid, such as water. Adapter brackets 58 are used to attach the low-pressure wand 32 to the high-pressure wand 30. In this embodiment, the high-pressure wand 30 is a standard high-pressure wand having a trigger 60 to control the flow of high-pressure fluid from the high-pressure wand 30. The water hose 36 connected to the storage tank 38 is connected to a control valve of the low-pressure wand 32. The control valve 62 is a throttle valve that enables a user to establish a desired flow rate of solution into the high-pressure fluid stream. The low-pressure wand 32 also has an isolation valve 64 that enables a user to start and stop the flow of solution. The low-pressure wand 32 also has a handle 66 and a trigger 68 coupled to the isolation valve 64 to enable a user to operate the isolation valve 64. In addition, the low-pressure wand 32 has a tube 70 for conveying the solution to the adapter assembly 56.

Figure 4:
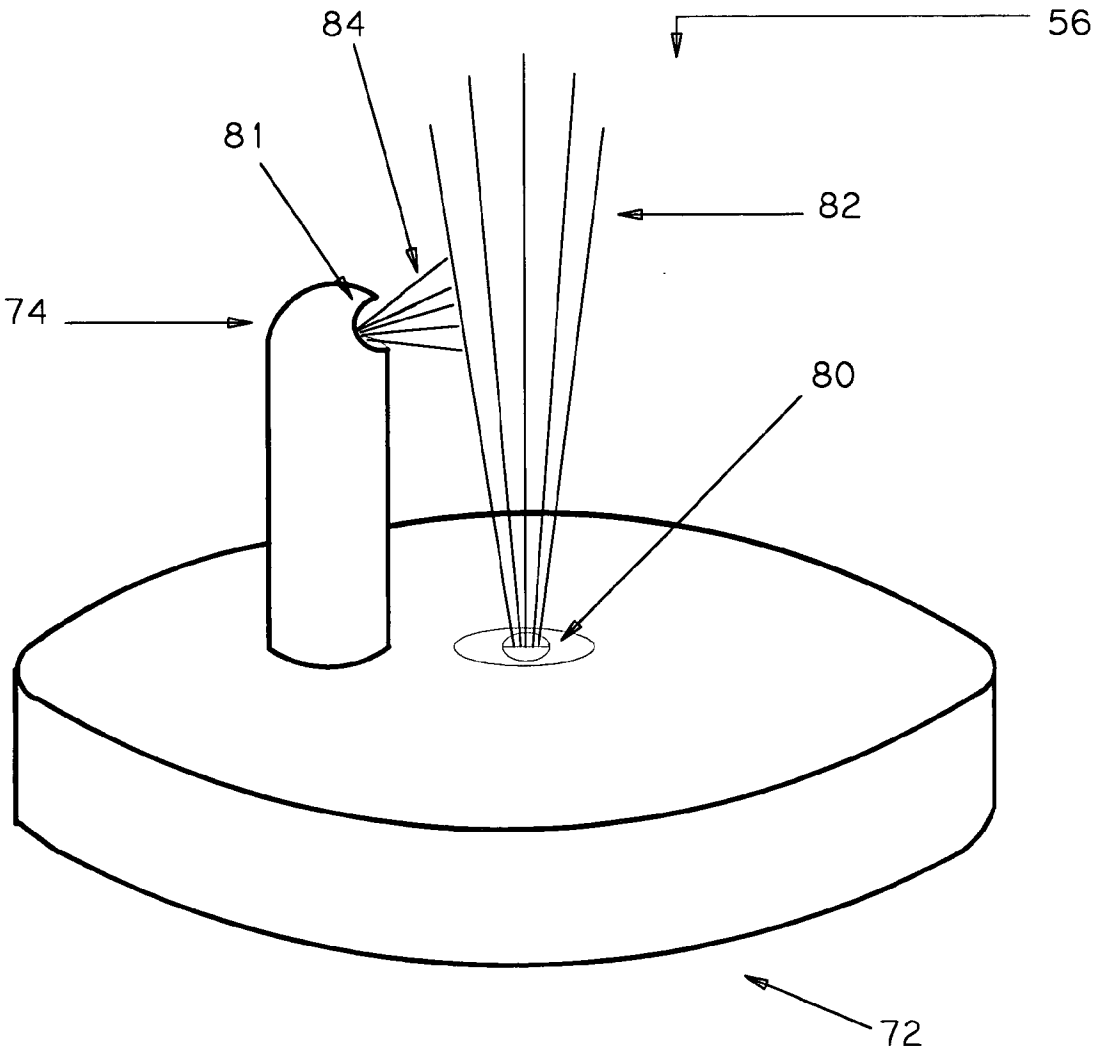
FIG. 4 is a perspective view of the adapter assembly of the portable pressure washer system of FIG. 1.
Figure 5:
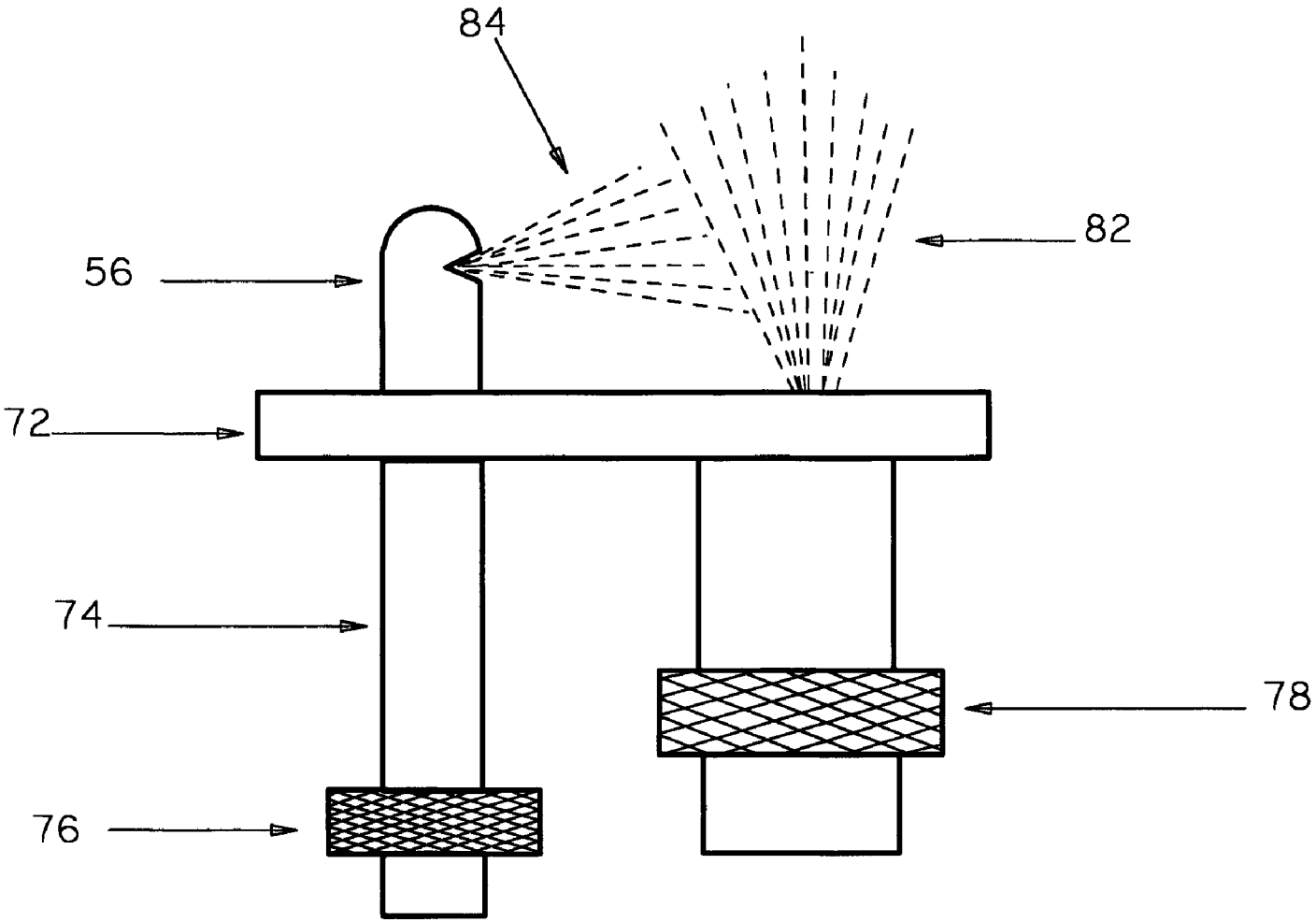
FIG. 5 is an elevation view of the adapter assembly of the portable pressure washer system of FIG. 1.

Referring generally to FIGS. 3–5, in the illustrated embodiment, the adapter assembly 56 comprises a mixer plate 72 and a bezel 74 extending through the mixer plate 72. The bezel 74 has a low-pressure quick coupling 76. In addition, the mixer plate 72 has a high-pressure quick coupling 78 for connecting the adapter assembly to the discharge of the high-pressure wand 30. The low-pressure wand 32 is connected to the low-pressure quick coupling 76. In the illustrated embodiment, a spay nozzle has been removed from the high-pressure wand 30 to enable the high-pressure wand 30 to be connected to the high-pressure quick coupling 78. The mixer plate 72 utilizes an orifice 80 to produce a spray, rather than the nozzle. However, the adapter assembly 56 may be provided without the orifice 80 so that the nozzle of the high-pressure wand 30 need not be removed. The high-pressure fluid 82 from the high-pressure wand 30 is coupled through the high-pressure quick coupling 78 to the orifice 80 in the mixer plate 72. The orifice 80 causes the flow of high-pressure fluid 82 to diverge. The bezel 74, in turn, is a hollow tube with a notch 81 to enable low-pressure solution to flow outward from within the bezel 74. The notch 81 produces a divergent flow of solution 84 that is directed to the high-pressure flow stream 82. The solution 84 becomes entrained in the flow of high-pressure fluid 82, carrying it towards a surface to be cleaned. By operating the control lever 68, illustrated in FIG. 3, to open or close the isolation valve 64, the flow of solution 84 may be started or stopped. In addition, by adjusting the control valve 62, the amount of solution 84 that is injected into the high-pressure flow stream 82 when the isolation valve 64 is open may be adjusted.

Figure 6:
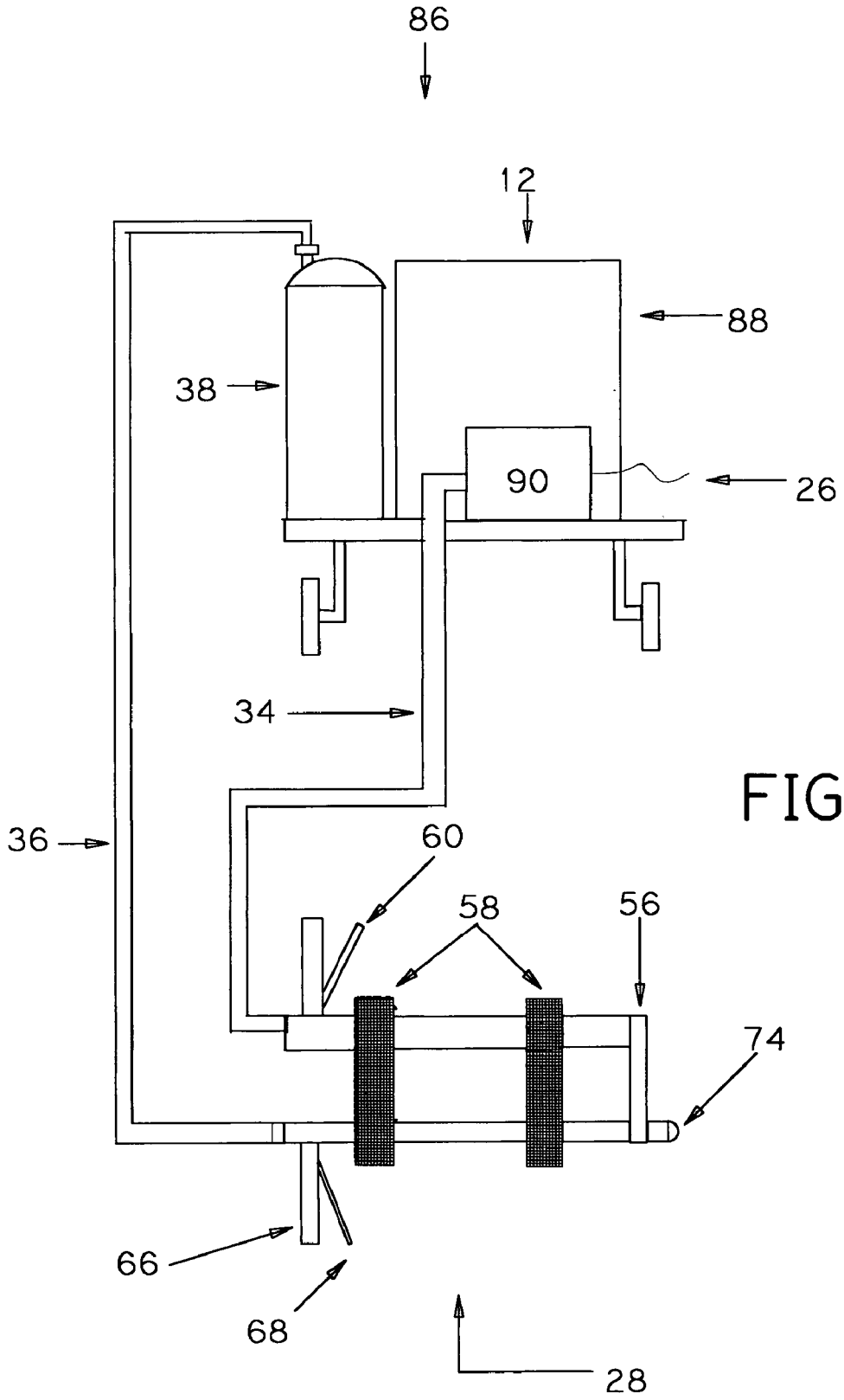
FIG. 6 is an elevation view of a portable pressure washer system, in accordance with an alternative embodiment of the present technique.
Figure 7:
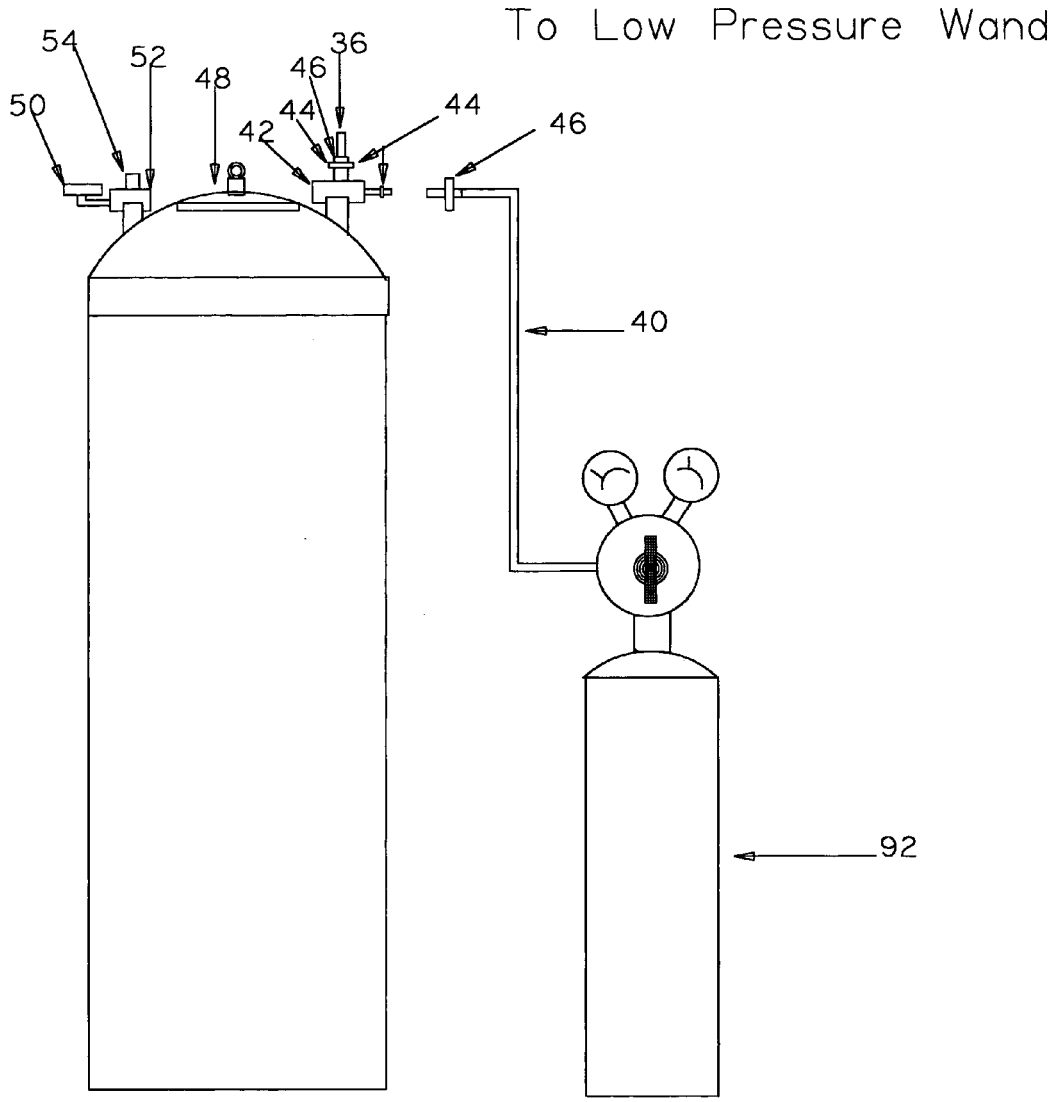
FIG. 7 is an elevation view of an example of a regulated gas cylinder being used to pressurize the storage tank, in accordance with a second alternative embodiment of the present technique.

Referring generally to FIG. 6, an alternative embodiment of a pressure washer system 86 is illustrated. In this embodiment, the pressure washer system 86 comprises an engine 88 and a direct-drive water pump 90. However, the illustrated system 86 does not include a compressor. However, the storage tank may be pressurized in a variety of ways. For example, as illustrated in FIG. 7, the storage tank 38 may be pressurized by a regulated gas bottle 92.

Figure 8:
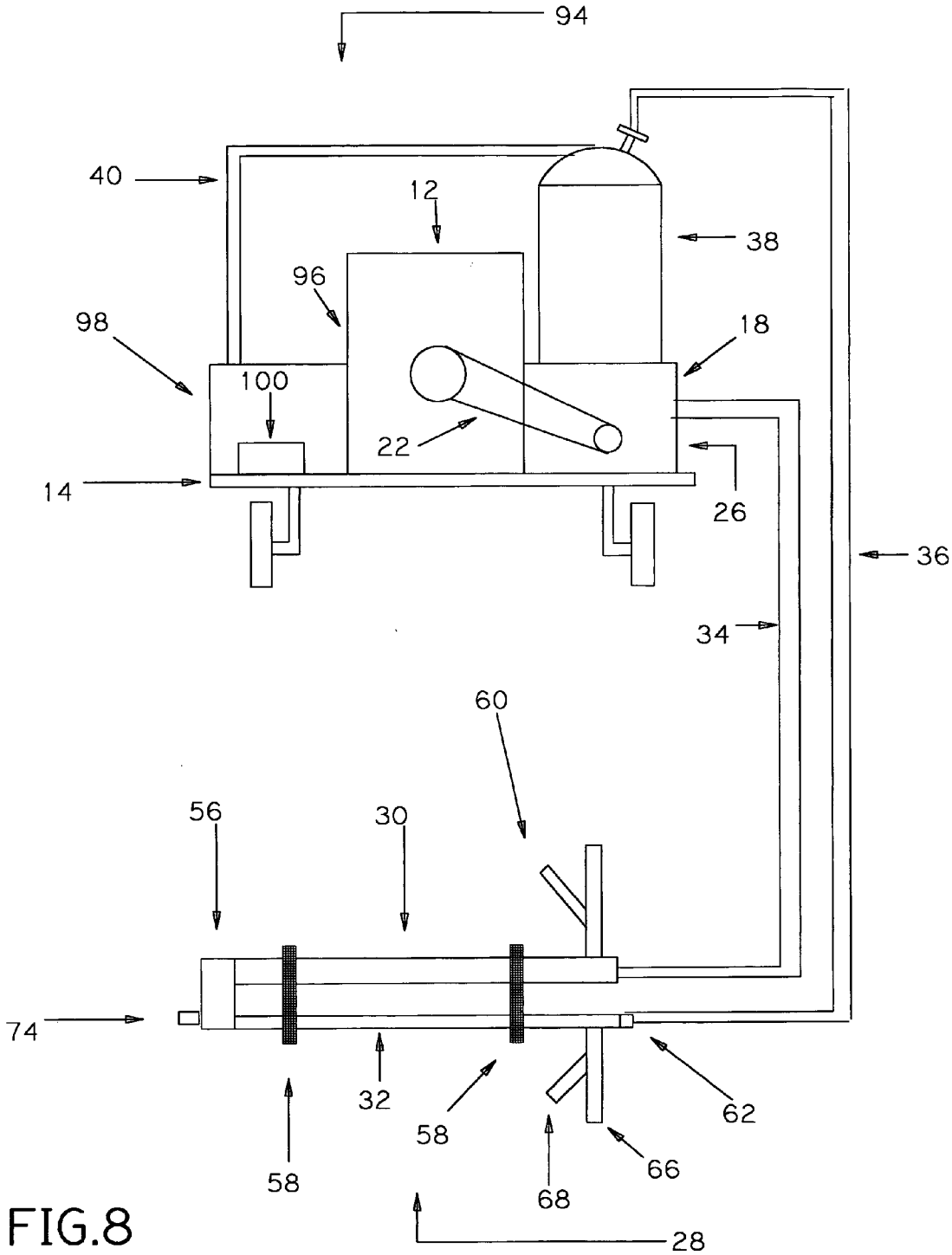
FIG. 8 is an elevation view of a portable pressure washer system, in accordance with a second alternative embodiment of the present technique.

Referring generally to FIG. 8, a second alternative embodiment of a pressure washer system 94 is illustrated. In this embodiment, the pressure washer system 94 comprises an engine 96 and a separately-powered compressor 98. In the illustrated embodiment, the compressor 98 is powered by a battery 100. However, another source of electricity may be used to provide electricity for the compressor 98, such as a 12 VDC source, or even AC from a line source. However, the compressor 98 may also be driven by an engine.

Figure 9:
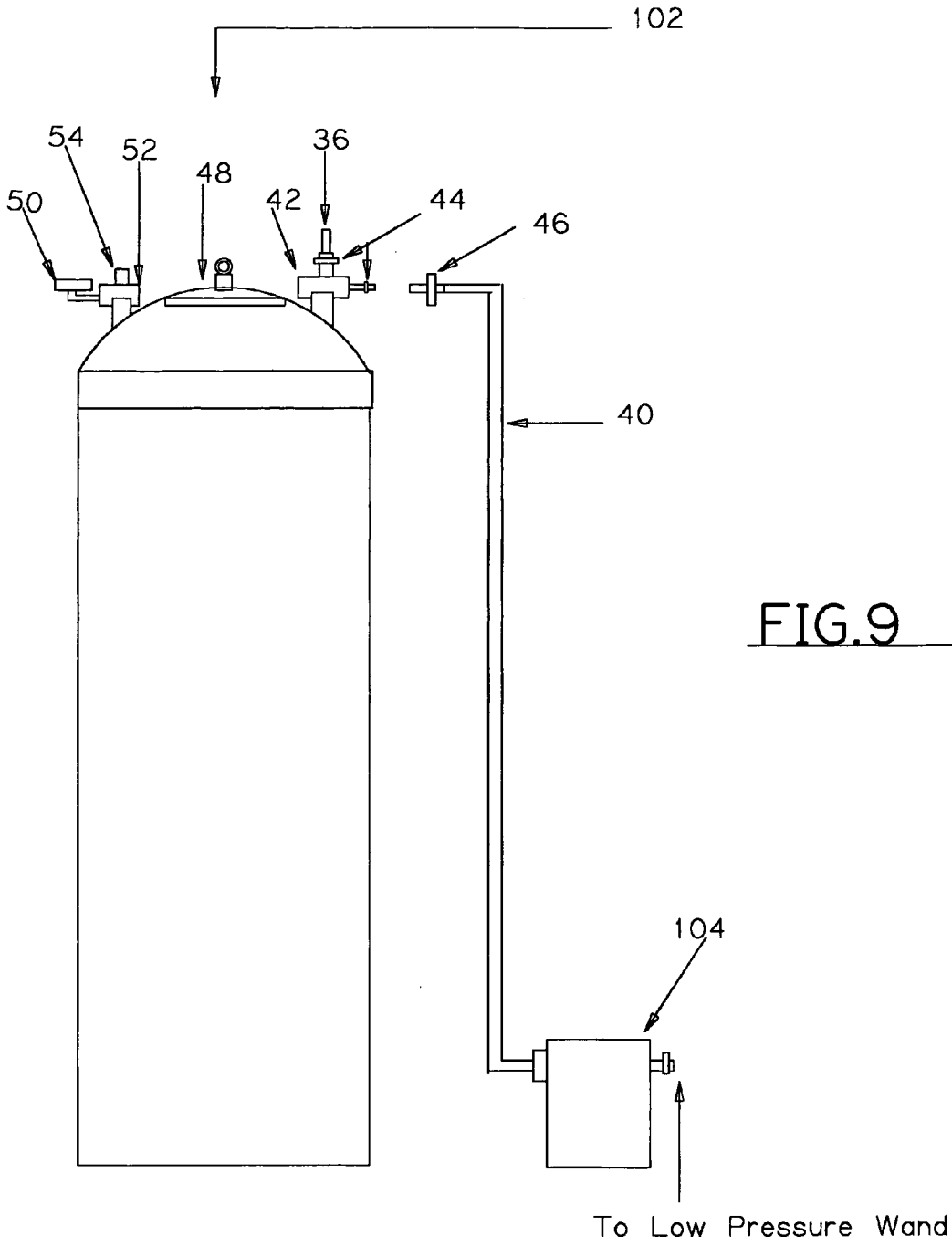
FIG. 9 is an elevation view of an example of an electric pump being used to pump fluid from the storage tank, in accordance with a third alternative embodiment of the present technique.

Referring generally to FIG. 9, a third alternative embodiment of a pressure washing system 102 is illustrated. In this embodiment, the storage tank 38 is not pressurized. Rather, an electric pump 104 is used to pump the solution from the storage tank 38 to the low-pressure wand 32. An AC or a DC pump may be used.

The techniques described above provide a pressure washing system that enables a low-pressure solution to be injected into a high-pressure fluid flow downstream of the pump used to produce the high-pressure in the fluid. In addition, because a pressurized tank is used to produce the motive force for the low-pressure solution, solutions normally harmful to a pump may be used, such as a caustic solution. In addition, the techniques described above enable an existing pressure washing system to be modified with one or more of the devices described above so as to enable the system to inject a low-pressure fluid into a high-pressure fluid stream.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A pressure washing system, comprising:

a first pump operable to produce a flaw of a first liquid at a pressure of at least 600 p.s.i.g.;

a storage tank operable to store a second liquid;

a second pump operable to produce a flow of second liquid from the storage tank; and a wand assembly coupled to the first pump and to the second pump, the wand assembly comprising a first wand, wherein the wand assembly is adapted to produce a spray of first liquid in an axial direction relative to the first wand and a spray of second liquid that is directed towards the spray of first liquid in a second direction relative to the first wand, the axial direction and the second direction being different, such that the spray of second liquid is entrained in the spray of first liquid and thereby re-directed to travel in the axial direction relative to the first wand.

2. The pressure washer as recited in claim 1, comprising an engine drivingly coupled to the first pump.

3. The pressure washer as recited in claim 1, wherein the wand assembly comprises:

a second wand secured to the first wand and in fluid communication with the second pump, wherein the first wand is operable to control the flow of first liquid and the second wand is operable to control The flow of the second liquid.

4. The pressure washer as recited in claim 3, wherein the second wand comprises an isolation valve operable to establish or secure the flow second liquid trough the second wand.

5. The pressure washer as recited in claim 4, wherein the second wand comprises a throttle valve operable to throttle the flow of second liquid though the second wand.

6. The pressure washer as recited in claim 3, comprising an adapter assembly secured to the first wand and the second wand, wherein the adapted assembly comprises a first orifice and the flow of second liquid is directed through the first orifice to produce the spray of second liquid that is directed transversely toward the spray of first liquid.

7. The pressure washer as recited in claim 6, wherein the adapter assembly comprises a second orifice to produce the spray of first liquid.

8. A kit for modifying a pressure washing system having a first pump operable to pump water to a pressure washing wand to produce a high-pressure spray of liquid, the kit comprising:

a storage tank operable to store a liquid;

a second pump operable to pump liquid from the storage tank; and a wand assembly in fluid communication with the storage tank via the second pump and securable to the pressure washing wand, wherein the wand assembly is operable to produce a second spray of liquid using the liquid in the storage tank, the wand assembly being adapted to direct the centerline of the second spray of liquid toward the axis of the pressure washing wand in a direction substantially transverse to the pressure washing wand so as to entrain the liquid from the storage tank in the high-pressure spray of liquid.

9. The kit as recited in claim 8, wherein the wand assembly comprises at least one bracket operable to secure the wand assembly to the pressure washer wand.

10. The kit as recited in claim 8, wherein the wand assembly comprises a low-pressure wand comprising an isolation valve to enable a user to control the flow of liquid from the storage tank.

11. The kit as recited in claim 10, wherein the wand assembly comprises a throttle valve in series with the isolation valve to enable a user to throttle the flow of liquid from the storage tank when the isolation valve is open.

12. The kit as recited in claim 10, wherein the wand assembly comprises an adapter assembly removably securable to the pressure washer wand, wherein the adapter assembly comprises an orifice to produce the second spray of liquid from the storage tank.

13. The kit as recited in claim 12, wherein the adapter assembly comprises a quick coupling coupleable to a corresponding quick coupling on the pressure washer wand.

14. The kit as recited in claim 12, wherein the adapter assembly comprises an orifice operable to produce a high-pressure spray from a flow of liquid from the pressure washer wand.

15. A method of modifying a pressure washing system operable to produce a high-pressure spray of a first liquid from a first pump via a first pressure washing wand, comprising:

coupling an inlet of a second pump in fluid communication with a liquid storage tank to enable the second pump to pump a second liquid from the liquid storage tank;

coupling a second pressure washing wand in fluid communication with an outlet of the second pump to enable the second pressure washing wand to receive the second liquid from the liquid storage tank and to produce a spray of second liquid therefrom; and securing the second pressure washing wand to the first pressure washing wand to enable the second pressure washing wand to direct the center of the spray of second liquid in a substantially transverse direction relative to the axis of the first pressure washing wand.

16. The pressure washer system as recited in claim 1, wherein the second direction is transverse relative to the first wand-assembly.

17. The kit as recited in claim 8, further comprising at least one battery operable to provide power to the second pump.

18. The method as recited in claim 15, further comprising coupling a battery to the second pump to enable the battery to provide power to operate the second pump.

19. The method as recited in claim 15, further comprising scouring the second pump to the pressure washing system.

20. The method as recited in claim 15, further comprising securing the liquid storage tank to the pressure washing system.

* * * * *